US005477016A

United States Patent [19]

Baginski et al.

[11] Patent Number: 5,477,016

[45] Date of Patent: Dec. 19, 1995

[54] CIRCUIT BREAKER WITH REMOTE CONTROL AND DISCONNECTION FUNCTION

[75] Inventors: Pierre Baginski, Grenoble; Jean-Pierre Nebon, St. Martin-Le-Vinoux; Michel Faure, St. Paul-De-Varces, all of France

[73] Assignee: Merlin Gerin, France

[21] Appl. No.: 191,126

[22] Filed: Feb. 3, 1994

[30] Foreign Application Priority Data

Feb. 16, 1993 [FR] France ..... 93 01823

[51] Int. Cl.[6] ..... H01H 9/28

[52] U.S. Cl. ..... 200/43.11; 200/43.14; 200/43.01; 200/308

[58] Field of Search ..... 200/43.11, 43.14, 200/43.15, 43.01, 43.16, 308, 318, 318.1, 323, 324, 325, 327, 400, 328, 330, 331, 332, 332.1

[56] References Cited

U.S. PATENT DOCUMENTS 2,854,555 9/1958 Edmunds .
3,171,908 3/1965 Malota ..... 200/43.11
4,128,750 12/1978 Castonguay et al. ..... 200/308
5,140,115 8/1992 Morris ..... 200/308

FOREIGN PATENT DOCUMENTS 2390569 12/1978 France .
3045568 6/1982 Germany .

*Primary Examiner*—Henry J. Recla
*Assistant Examiner*—David J. Walczak
*Attorney, Agent, or Firm*—Parkhurst, Wendel & Rossi

[57] ABSTRACT

A circuit breaker equipped with an add-on remote control unit comprises a mechanical transmission link independent from the main mechanism, to transmit the position of the movable contact to an indicator, which automatically unlocks a latch in the open position to enable padlocking of a rack. The mechanical link is in two parts, composed of a push-rod associated with an operating lever on which the indicator is arranged, and a link rod articulated on the switching bar.

6 Claims, 4 Drawing Sheets

CIRCUIT BREAKER WITH REMOTE CONTROL AND DISCONNECTION FUNCTION

BACKGROUND OF THE INVENTION

The invention relates to a remote controlled circuit breaker comprising a remote control unit which can be fitted to a multipole circuit breaker having an insulating case housing in each pole a system of separable contacts actuated by a switching bar between a closed position and an open position and vice-versa, said remote control unit comprising:

- a mechanism equipped with a gearing-down device and operating means enabling rotation of the insulating bar between the closed and open positions,
- means for local display of the open or closed state of the contacts system,
- and lockout means for locking the contacts system in the open position providing a visible break disconnection function of the circuit breaker.

The visible break disconnection function means that the actuating and/or display devices of the circuit breaker must not be able to indicate the open state when the contacts are not effectively separated for interruption of the circuit. Likewise, locking by actuating a keylock or fitting a padlock in the open position of the circuit breaker must only be possible if the contacts are open. In the circuit breakers with add-on remote control units which are generally used, the open or closed state of the contacts information is generally given by the relative position of the pin or handle of the circuit breaker unit. Indication of the state of the contacts, and locking of the circuit breaker in the open position in this case require operation of the circuit breaker operating mechanism, with risks of putting stress on movable parts linked to the movable contacts of the different poles, notably in the case of soldered contacts.

SUMMARY OF THE INVENTION

The object of the invention is to improve the disconnection function of a circuit breaker with an add-on remote control unit.

The circuit breaker according to the invention is characterized in that the display means are arranged on an operating lever linked to the bar by an independent mechanical transmission link, composed of two parts comprising a push-rod in contact inside the remote control unit with a transmission finger of the operating lever, and comprising a position sensor coming into abutment with a link rod located in the case of the circuit breaker unit and articulated on the bar, and that the operating lever is provided with a latching part able to cooperate with the lockout means to lock or unlock an extractable rack from a locking latch depending on whether the contacts are in the open or closed state.

According to one feature of the invention, the extractable rack is equipped with an orifice for fitting the padlocking device in the unlocked state of the rack, and with a retaining part cooperating with the latching part of the operating lever.

The display means indicate the position of the contacts via the mechanical link which is independent from the circuit breaker mechanism. The parts of the latter are not subjected to any mechanical stress when the locking latch is padlocked in the open position. This padlocking can only take place after the locking latch has been unlocked by the indicator when the latter is moved by the mechanical link to the open position.

The presence of this independent mechanical link constitutes a positive safety system.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DETAILED DESCRIPTION OF THE PREFERRED EMBODIMENT

Figure 1:
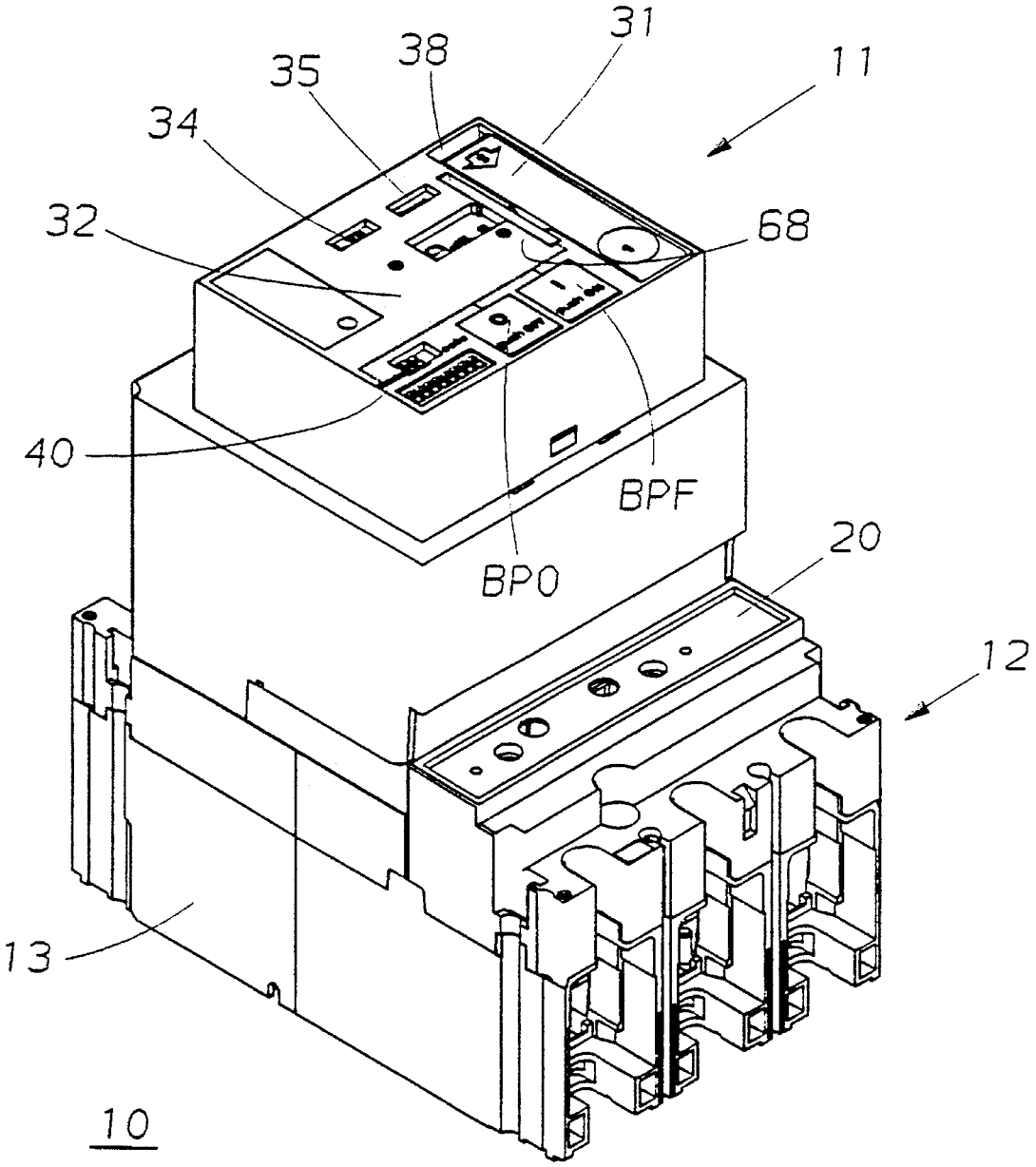
FIG. 1 is a perspective view of a remote controlled circuit breaker according to the invention.

In FIGS. 1 to 4, a remote controlled circuit breaker 10 is composed of an energy storage remote control unit 11, comprising an add-on module designed to be fitted onto a circuit breaker unit 12 with molded insulating case 13.

The circuit breaker 12 is of the low voltage multipole type, having per pole a separable contacts system 14, the movable contact 16 of which is securedly united to a transverse switching bar 18, driven in rotation by an operating mechanism (not represented) with trip device 20.

The contacts system 14 comprises for example a movable contact 16 in the form of a double-break rotating bridge cooperating with a pair of stationary contacts 22, 24, such as described in the document FR-A-2,622,347 filed by the applicant. It is obvious that a single-break contacts device can also be used.

Figure 2:
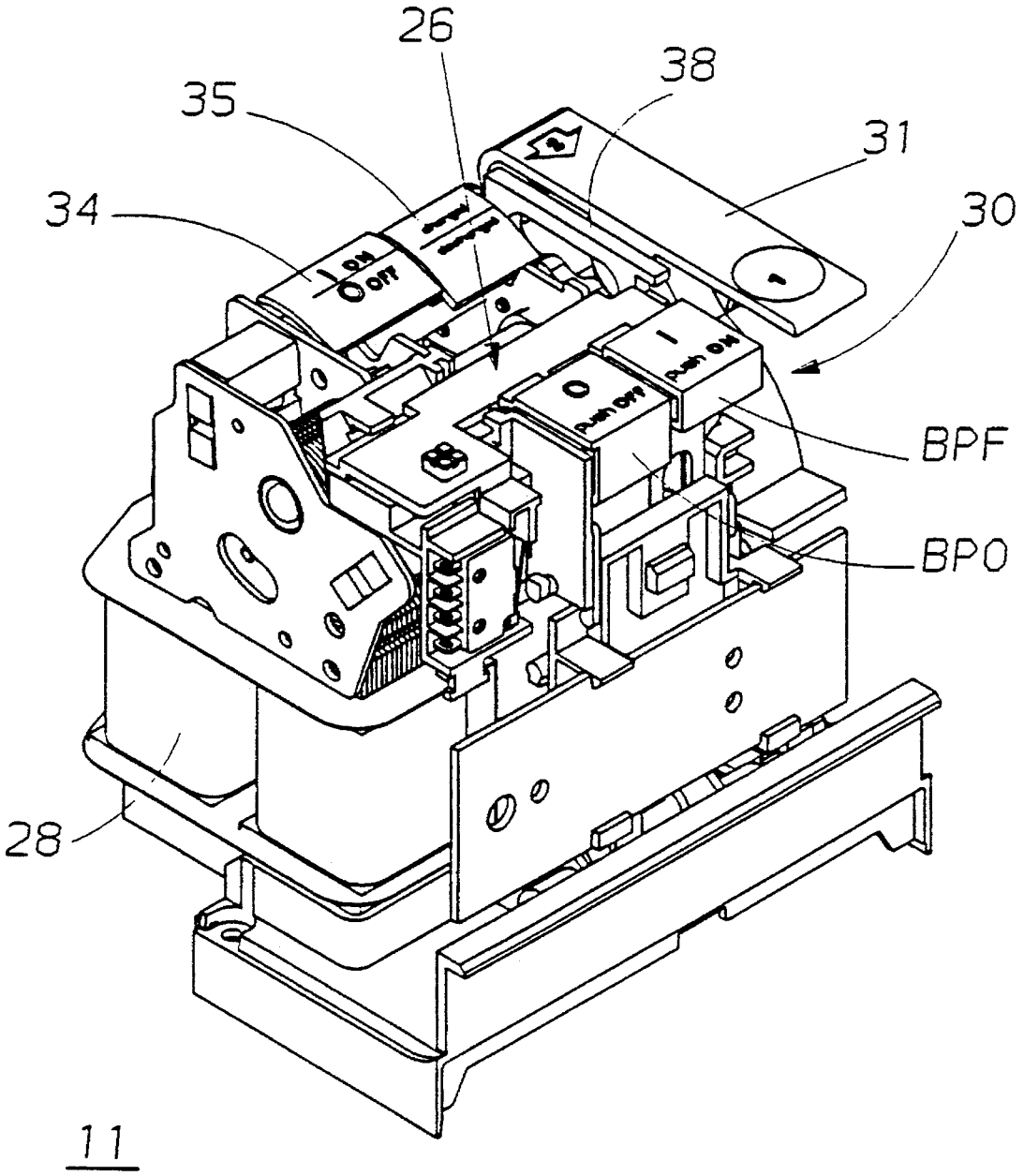
FIG. 2 shows a perspective view of the remote control unit after the cover has been removed.

The remote control unit 11 is placed on the circuit breaker unit 12 covering the pin (not represented) to operate the bar 18 via the operating device of the circuit breaker 12, and houses a mechanism 26 with an energy storage spring, inserted between a gearing-down component 28, and an emergency manual control 30, only the handle 31 of which is represented in FIG. 2. The front panel 32 of the remote control unit 11 comprises:

- a closing push-button BPF and an opening push-button BPO, whose actuation respectively causes closing and opening of the contacts 16, 22, 24,
- a first indicator 34 for local indication of the open or closed state of the contacts system 14 of the circuit breaker 12,
- a second indicator 35 actuated by the energy storage system of the mechanism 26 to indicate the charged or discharged state of the remote control unit 11,
- a locking latch 38 to lock the remote controlled circuit breaker 10 in the open position providing a disconnection function,
- and an automatic/manual mode setting selector 40 designed to connect or disconnect the gearing-down device 28.

The first indicator 34 is arranged at the top end of an operating lever 36 pivotally mounted on a spindle 37. The lever 36 comprises on the one hand a latching part 43 cooperating with a retaining pin 41 of the locking latch 38, and on the other hand a transmission finger 42 located at the bottom end and engaged in an opening 44 of a movable push-rod 46.

Figure 3:
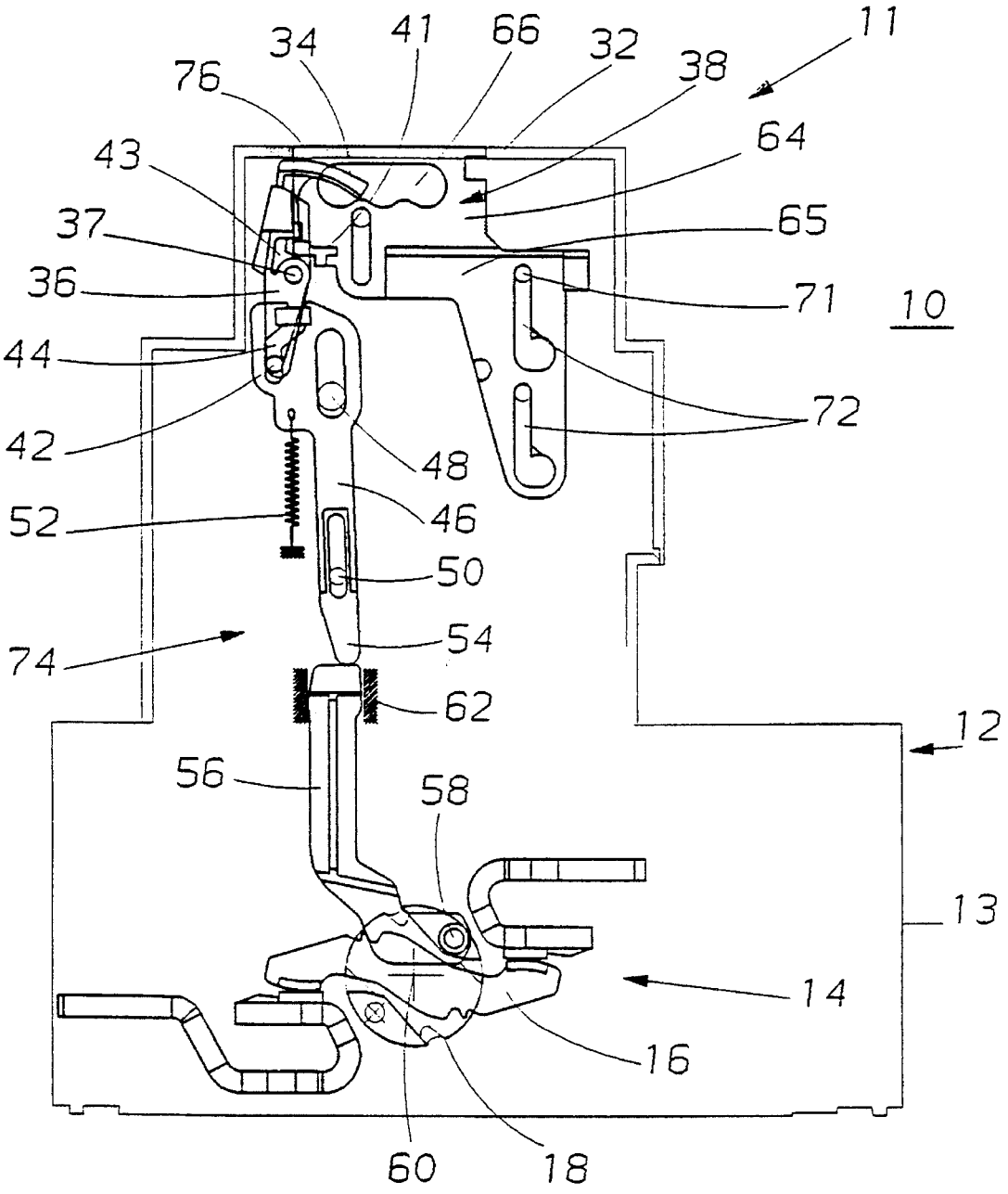
FIG. 3 represents a schematic longitudinal cross-sectional view of the disconnecting device incorporated in the remote controlled circuit breaker, whose contacts are in the closed position.
Figure 4:
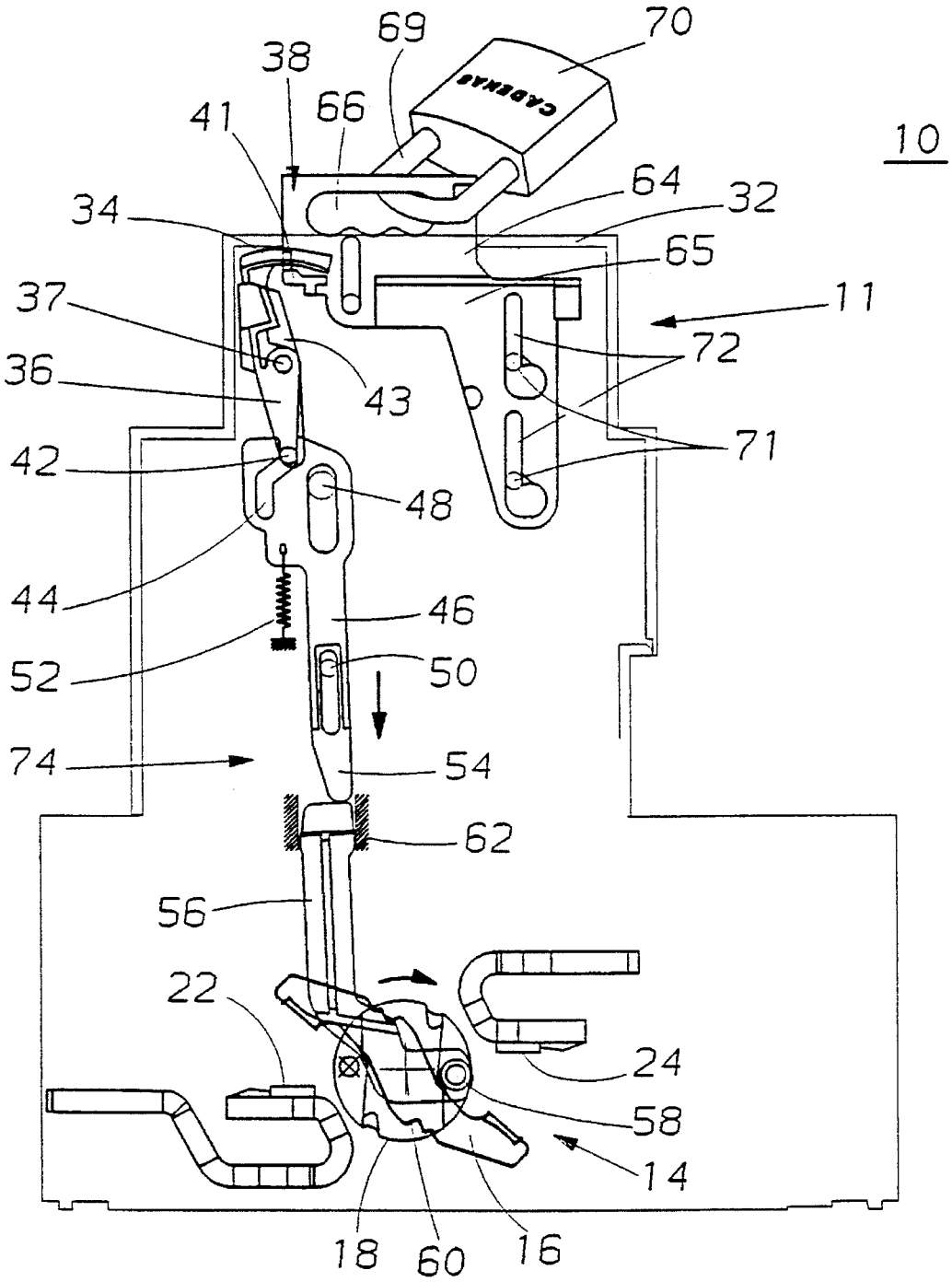
FIG. 4 is an identical view to FIG. 3, the circuit breaker being in the open/disconnected position with fitting of a padlock.

The push-rod 46 is guided in translation by fixed pins 48, 50 between a first raised position corresponding to the closed state of the contacts (FIG. 3) and a second lowered position corresponding to the open state of the contacts (FIG. 4). A return spring 52 notably of the tension type, urges the push-rod 46 towards the second position. The latching part 43 of the lever 36 is located between the spindle 37 and the indicator 34.

Opposite from the transmission finger 42, the push-rod 46 is equipped with a position sensor 54 coming into abutment with a mobile link rod 56, articulated at a point 58 of the switching bar 18. The articulation point 58 is eccentric with respect to the axis 60 of the bar 18, and the upper part of the link rod 56 cooperating with the sensor 54 is guided in translation by means of a slide 62 provided in a spacer separating the poles of the case 13.

The locking latch 38 comprises an extractable rack 64 equipped with a padlocking orifice 66 able to occupy an inserted position (FIG. 3) in which the orifice 66 is not accessible from the front panel 32, and an extracted position in which the rack 64 protrudes partially out through the slot 68 located on the front panel 32, to enable a bow 69 of a padlock 70 to be passed through, The extraction travel of the rack 64 in translation is defined by guide pins 71 sliding along straight apertures 72 of predetermined lengths, arranged in a fixed support 65 of the rack 64.

The pivoting second indicator 35 is actuated directly in conventional manner by the loading cam (not represented) of the closing spring of the mechanism 26.

Implementation of the disconnection function of the mechanism 26 is achieved as follows:

The first indicator 34 of the operating lever 36 indicates the position of the contacts 16, 22, 24 by means of the mechanical transmission link 74 in two parts, composed of the push-rod 46 with position sensor 54, and the link rod 56 associated to the bar 18.

In FIG. 3, the contacts 16, 22, 24 are closed and the thrust of the mechanical link 74 urges the operating lever 36 in rightwards pivoting, displaying the closed state of the indicator 34 through a window 76 of the front panel 32. In this stable position, the retaining pin 41 of the rack 64 is retained by the latching part 43 of the operating lever 36, and therefore performs positive blocking of the latch 38 in the inserted position. Pulling the rack 64 out to the extracted position is made impossible due to the locking action exerted on the latch 38, and the orifice 66 is inaccessible. Any attempt to fit the padlock 70 in the closed position of the contacts system 14 is thus prevented.

When opening of the contacts 16, 22, 24 takes place, the link rod 56 moves downwards following the clockwise rotation of the bar 18, and the first sensor 54 follows the movement of the link rod 56 due to the action of the spring 52. The downwards movement of the push-rod 46 makes the transmission finger 42 react on the opening ramp 44, and imposes simultaneous leftwards pivoting of the operating lever 36 with switching of the indicator 34 to the open state. The movement of the lever 36 causes automatic release of the retaining pin 41 from the latching part 43 resulting in unlocking of the latch 38. A voluntary extraction action of the rack 64 is then possible to fit the padlock 70 in place (FIG. 4).

Padlocking of the latch 38 after unlocking by the operating lever 36 of the indicator 34, and local indication of the open state of the indicator 34 constitute the parameters of the visible break disconnection function, via which we can be sure that the contacts 16, 22, 24 are effectively open.

The mechanical link 74 for transmission of the movement of the contacts to the indicator 34 constitutes a kinematic chain separate from the actuating mechanism 26 of the handle of the circuit breaker 12. The presence of this independent link enables the remote controlled circuit breaker 10 to be locked in the open position without putting a stress on movable parts actuating the movable assembly of the main mechanism. Any forced action on one of the push-buttons BPF and BPO located on the front panel 32 does not have any effect on the mechanism 26, and the contacts 16, 22, 24 remain locked in the open position by padlocking of the latch 38. The mechanical transmission link 74 between the bar 18 and indicator 34 constitutes a positive safety system, even in the event of accidental breaking of the return spring 52.

We claim:

1. A remote controlled circuit breaker, comprising:

a multipole circuit breaker unit including an insulating case, each pole of the multipole circuit breaker unit being housed in the insulating case and including a system of separable contacts which is driven by a rotatable switching bar between open and closed positions; and a remote control unit for fitting onto the multipole circuit breaker unit, said remote control unit including:

lockout means for locking the system of separable contacts in an open position, said lockout means comprising an extractable rack;

an operating lever including a transmission finger and a latching part, said latching part being adapted to latch said extractable latch of the lockout means to prevent extraction of the latch;

display means for displaying open or closed positions of said system of separable contacts, said display means being provided on said operating lever; and a mechanical transmission link which connects the operating lever to the switching bar, said mechanical transmission link comprising a link rod which is articulated on the switching bar, and a push rod which connects the link red to the transmission finger of the operating lever, whereby the operating lever is driven via rotation of the switching bar.

2. The remote controlled circuit breaker of claim 1, wherein the extractable rack includes a retaining pin which is received by the latching part, and an orifice for fitting a padlock device therethrough when the retaining pin is unlatched from the latching part of the operating lever.

3. The remote controlled circuit breaker of claim 1, wherein the operating lever is pivotally mounted on a spindle, said transmission finger being provided at a first end of the operating lever, the display means comprises an indicator which is secured to a second end of the operating lever opposite the first end, and the latching part is provided between the spindle and the indicator.

4. The remote controlled circuit breaker of claims 1, wherein said push rod is slidable between first and second positions corresponding respectively to closed and open positions of the system of separable contacts, and the remote control unit further comprises a spring for biasing the push rod toward said second position.

5. The remote controlled circuit breaker of claim 4, wherein a portion of the link rod is slidable in an orifice formed in the insulating case.

6. The remote controlled circuit breaker of claim 1, wherein the link rod is articulated on the switching bar at a position eccentric to a rotational axis of the switching bar.

* * * * *